US012270627B2

(12) United States Patent
Boudreau

(10) Patent No.: US 12,270,627 B2
(45) Date of Patent: Apr. 8, 2025

(54) SIGHT HAVING FLEXIBLE TARGET ADJUST

(71) Applicant: Sig Sauer, Inc., Newington, NH (US)

(72) Inventor: Christopher J. Boudreau, Estacada, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 18/074,359

(22) Filed: Dec. 2, 2022

(65) Prior Publication Data

US 2023/0175817 A1 Jun. 8, 2023

Related U.S. Application Data

(60) Provisional application No. 63/285,425, filed on Dec. 2, 2021.

(51) Int. Cl.
*F41G 1/54* (2006.01)
*F41G 1/30* (2006.01)

(52) U.S. Cl.
CPC ..... *F41G 1/545* (2013.01); *F41G 1/30* (2013.01)

(58) Field of Classification Search
CPC ..... F41G 1/16; F41G 1/30; F41G 1/545
USPC ..... 42/113
See application file for complete search history.

(56) References Cited

U.S. PATENT DOCUMENTS 2,189,766 A * 2/1940 Unertl ..... G02B 27/32 D16/132
5,400,540 A * 3/1995 Solinsky ..... F41G 1/36 42/117
2013/0133239 A1* 5/2013 Bowman ..... F41G 1/393 42/115

* cited by examiner

*Primary Examiner* — Bret Hayes
(74) *Attorney, Agent, or Firm* — Miller Nash LLP

(57) ABSTRACT

A target sight for a firearm includes a main body, an elongated, flexible emitter carrier having a first end fixed to the main body and having a movable portion at a second end opposite the first end, and a light emitter mounted to the movable portion of the flexible emitter carrier.

12 Claims, 9 Drawing Sheets

SIGHT HAVING FLEXIBLE TARGET ADJUST

CROSS-REFERENCE TO RELATED APPLICATION

This application claims priority to U.S. provisional patent application No. 63/285,425, titled "SIGHT HAVING TARGET ADJUST," filed Dec. 2, 2021, the disclosure of which is incorporated herein by reference in its entirety.

FIELD OF THE INVENTION

This disclosure is directed to targeting sights, and, more particularly, to targeting sights having a target emitter mounted to a flexible, adjustable, arm.

BACKGROUND

Reflex type gun sights, also commonly referred to as red-dot sights, provide a shooter a quick and easy way to sight a target compared to conventional iron sights. Reflex sights are optical sights that include a partially reflecting element on which an aiming light or target is projected. An LED or other light emitter is commonly used as the light source. When the emitter generates its light signal, the projected light reflects from the reflecting element, such as a lens or other optic, and the reflection is seen by the shooter as being superimposed on the target or field of view. This reflection is referred to as a Point of Aim (PoA). In operation, the shooter then aligns the target to the PoA to accurately aim the firearm at the target.

Modern reflex sights typically include a positioning apparatus to change the relative location of the emitted light on the reflective lens. Changing the relative location of the emitted light allows the shooter to compensate for targets at various distances or for a misalignment between the sight and the barrel. Without compensation, the shooter may have to aim the firearm at a non-indexed location that is different than the actual PoA to account for these effects.

A typical positioning apparatus on a reflex sight includes a positioning or carrier plate to which the light emitter is mounted. Then, the shooter may adjust the longitudinal and/or latitudinal position of the plate relative to the reflective lens of the optic, typically by turning threaded adjusters that are mechanically coupled to the plate. Moving the position of the carrier plate, in turn, moves the reflected position of the light emitted from the emitter back to the shooter, allowing the reflex sight to cause the targeting dot to be positioned in the new position. Positioning apparatuses on modern reflex sights are complex, require tight manufacturing tolerances, and are subject to wear and breakage. Further, it is possible that extreme shocks, such as caused by dropping the firearm, can cause the carrier plate to move or even dislodge. In addition, typical carrier plate systems can have undesirable phenomena while adjusting, such as non-linear travel, dead clicks, and inconsistency in resolution per revolution.

Embodiments according to the disclosure address these and other limitations of present sights.

DESCRIPTION

Figure 1A:
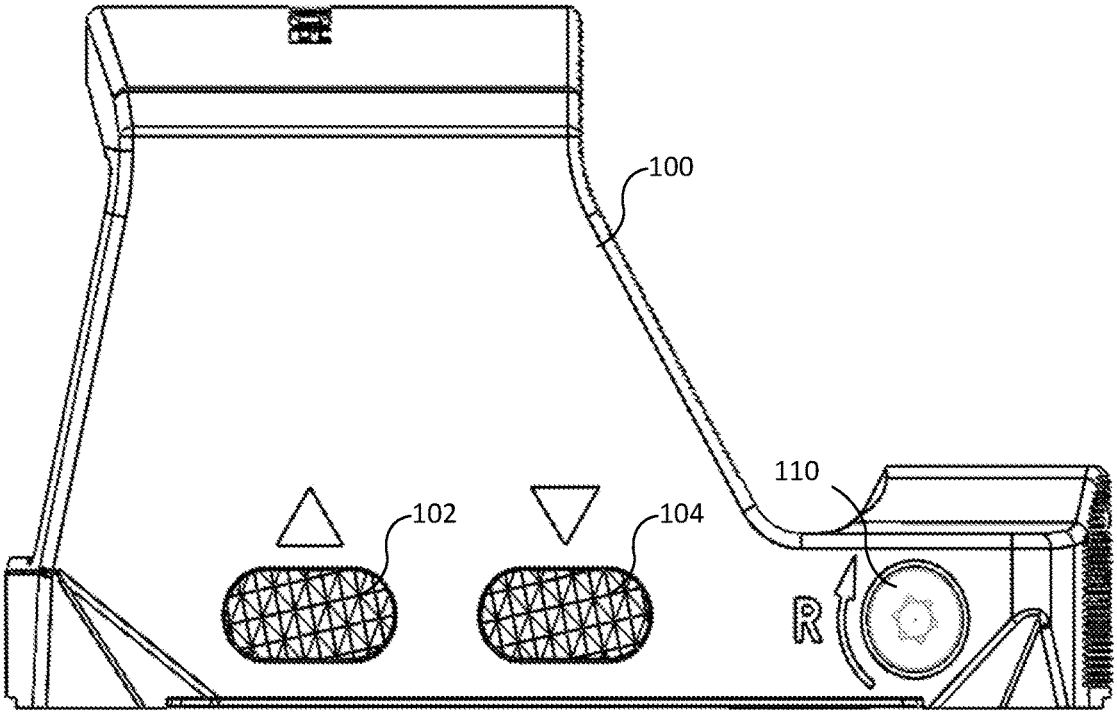
FIG. 1A is a first side view of a sight having target adjust according to embodiments of the disclosure.
Figure 1B:
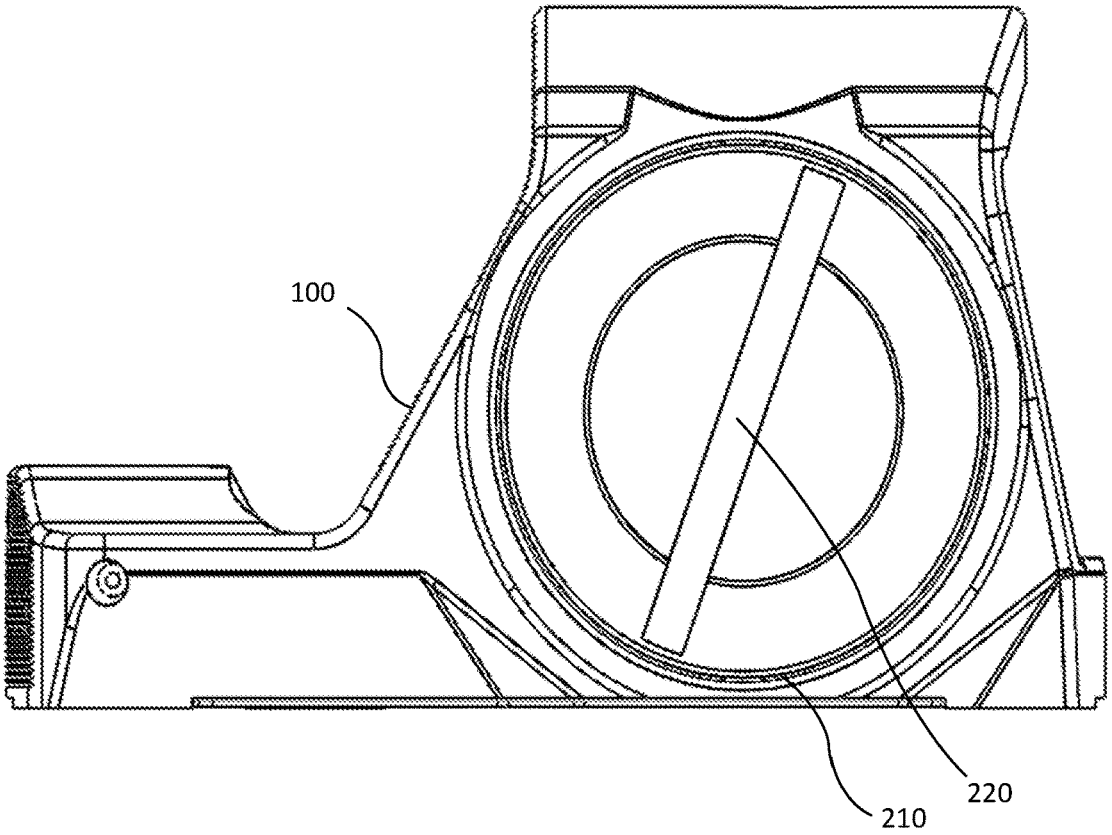
FIG. 1B is a second side view of a sight having target adjust according to embodiments of the disclosure.

FIGS. 1A and 1B illustrate side views of a target sight 100, which uses a light emitter to generate a target aiming light. As seen in FIG. 1A, brightness control buttons 102, 104 control the light intensity of a target light emitter that is within the target sight 100. A windage adjustment 110 controls a left/right position of the target light emitter, as discussed below.

Figure 2A:
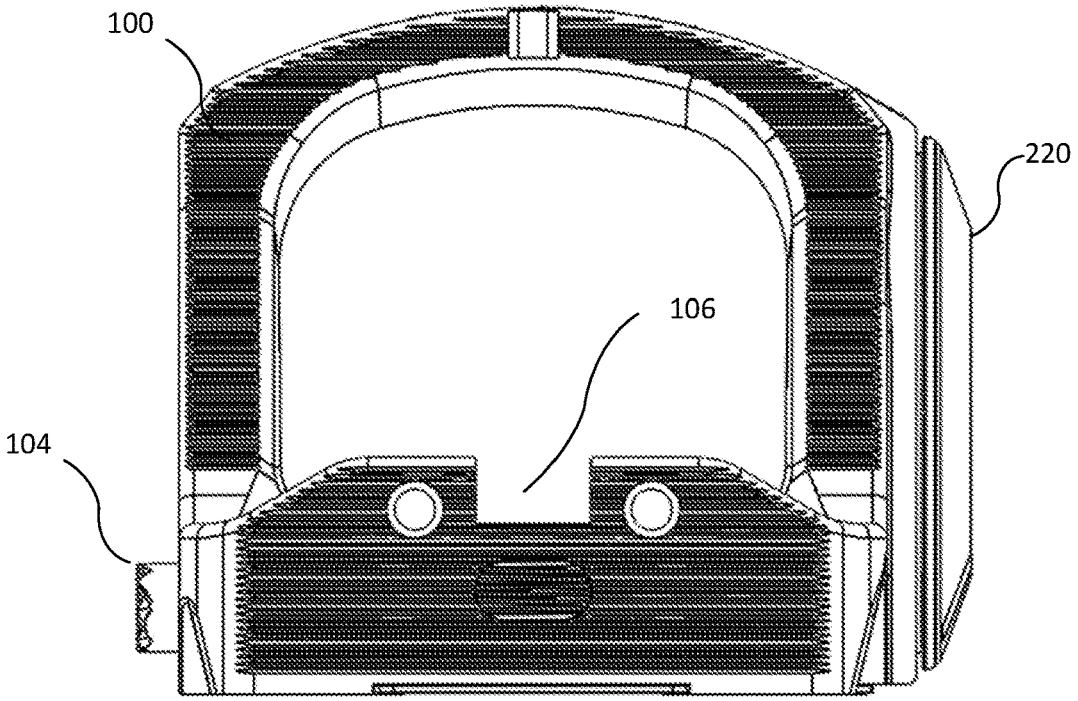
FIG. 2A is a rear view of a sight having target adjust according to embodiments of the disclosure.
Figure 2B:
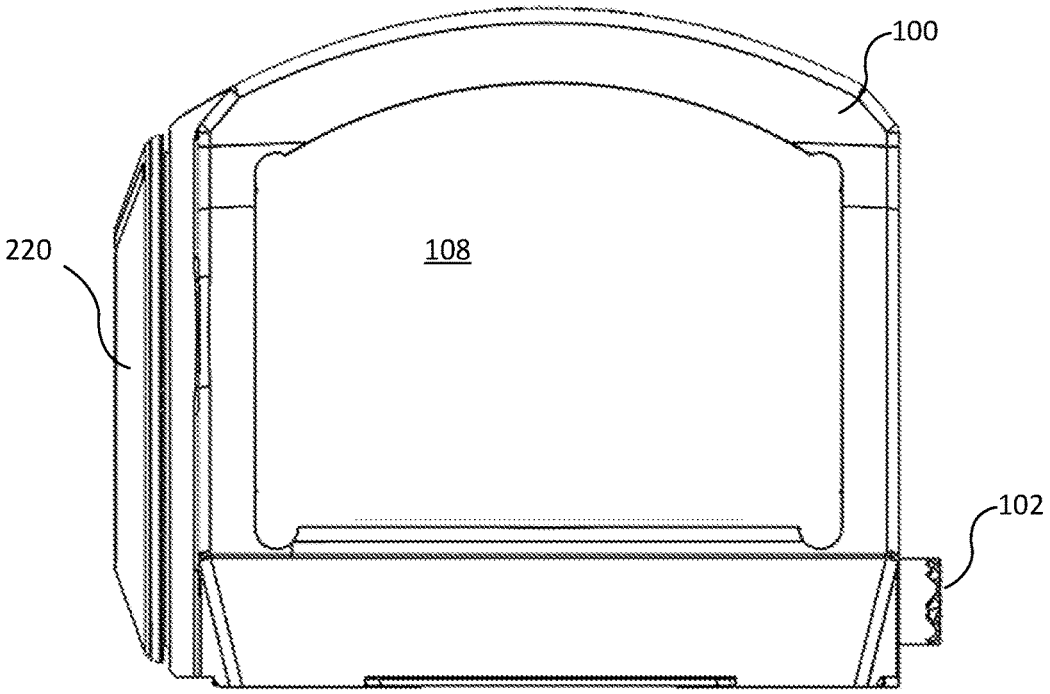
FIG. 2B is a front view of a sight having target adjust according to embodiments of the disclosure.

FIGS. 2A and 2B illustrate rear and front views of the target sight 100, respectively. A mechanical sight 106, commonly called an iron sight, allows the shooter to aim the firearm when the target sight 100 is not active, i.e., when the target light emitter is off. As illustrated in FIG. 2B, a reflective glass 108 is mounted near the front of the target sight and, among other purposes, provides a reflective surface for the target light emitter so that light generated by the target light emitter reflects off the reflective glass back to the shooter, which provides the point of aim (PoA).

Figure 3A:
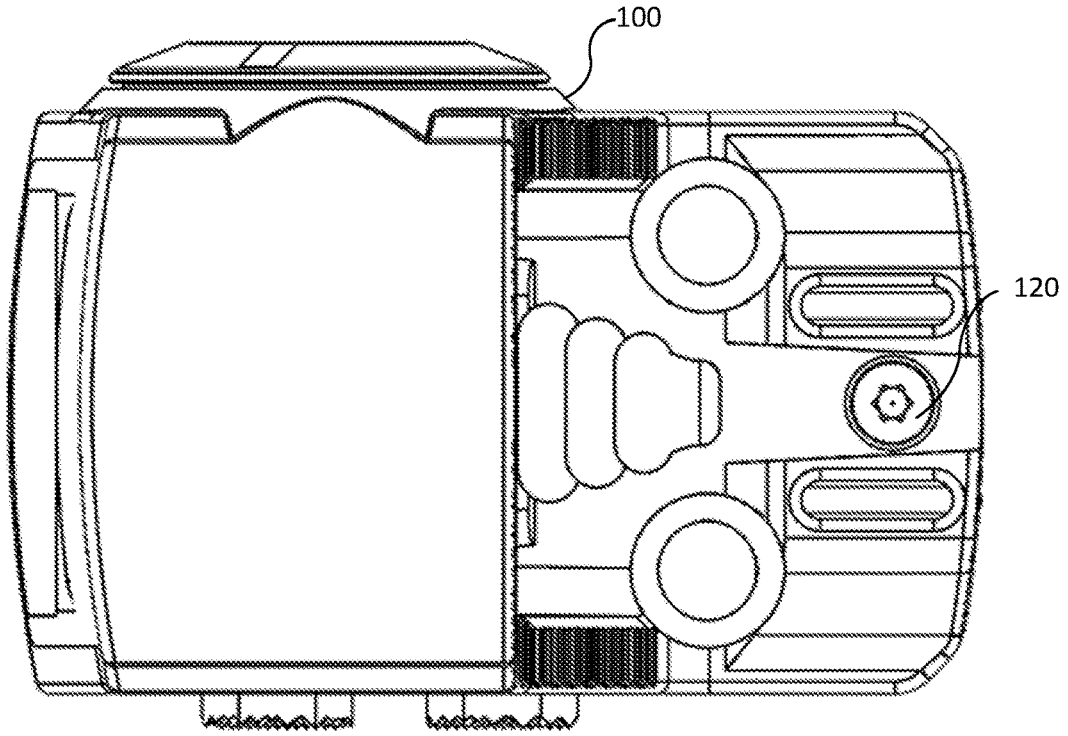
FIG. 3A is a top view of a sight having target adjust according to embodiments of the disclosure.

FIG. 3A, which is a top view of the target sight 100, illustrates an elevation adjustment 120, which controls an up/down position of the target light emitter, described in detail below.

Figure 3B:
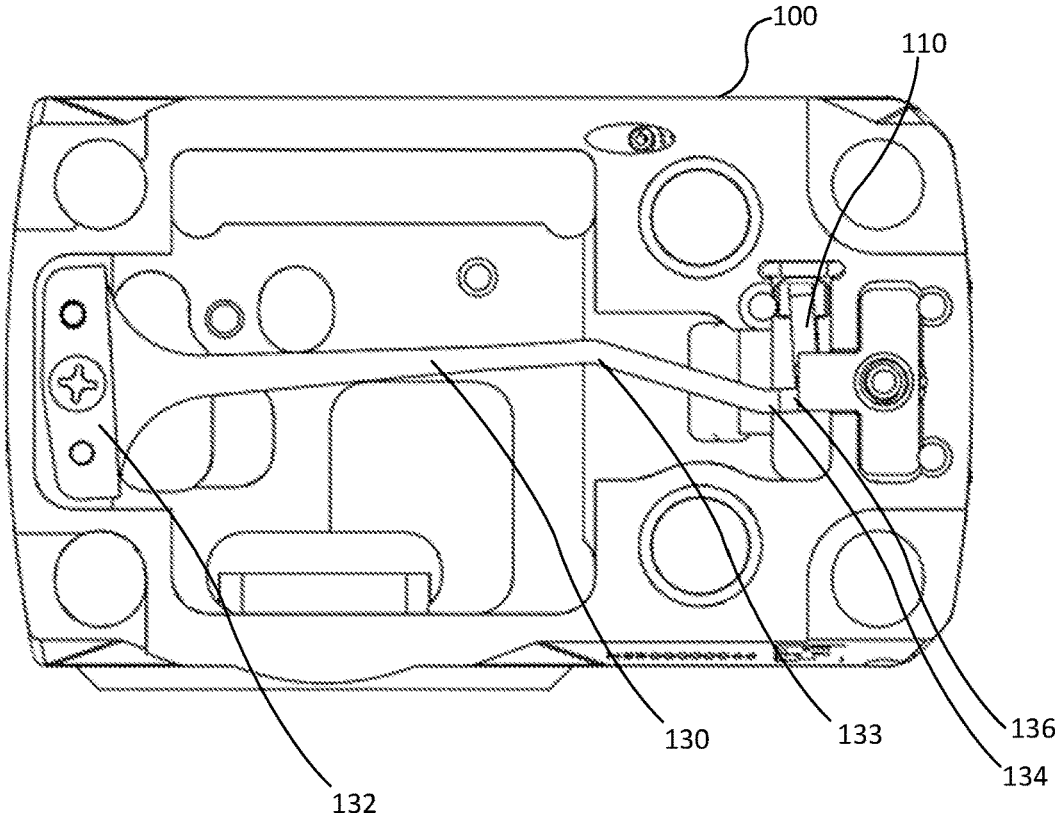
FIG. 3B is a rear view of a sight having target adjust according to embodiments of the disclosure.

FIG. 3B is a bottom view of the target sight 100, and illustrates a flexible cantilever arm 130, which is used in the target sight 100 to adjust a position of the target light emitter of the sight, as described below. The cantilever arm 130 includes a fixed end 132 and a controllably movable portion 134 at an end opposite the fixed end. The cantilever arm 130 may further include one or more pre-bends, such as pre-bend 133. Pre-bends may be horizontal, vertical, or a combination of horizontal and vertical. The controllably movable portion 134 of the cantilever arm 130 terminates in a termination 136, where the cantilever arm is coupled to an emitter carrier, which is occluded in FIG. 3B. The emitter carrier supports the target light emitter, which is also occluded, but shown in later figures. The target light emitter is typically a Light Emitting Diode (LED), but may be embodied by any type of light source. As describe below, the position of the emitter carrier may be adjusted using the windage and elevation adjustments 110, 120, which causes the position of the reflection of the targeting light generated by the target light emitter to move relative to the target sight 100.

Figure 4:
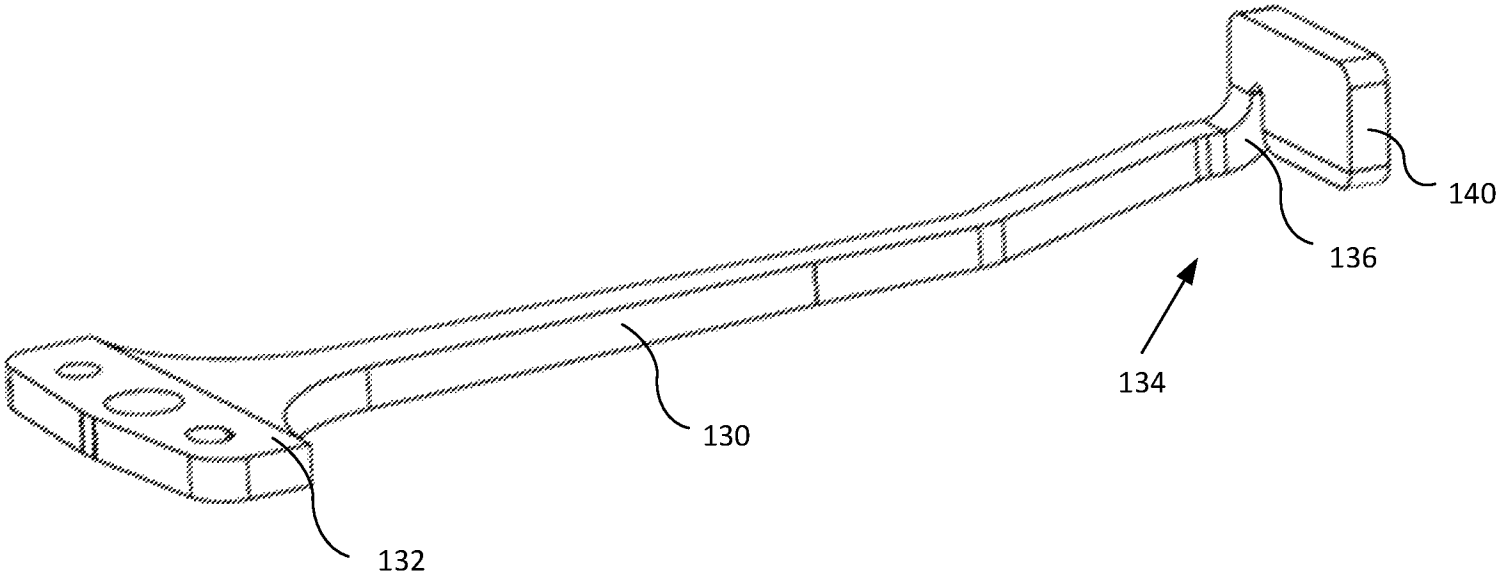
FIG. 4 is a side perspective view of a cantilever arm element of a target sight according to embodiments of the disclosure.

As best seen in FIG. 4, in the illustrated embodiment, the fixed end 132 of the cantilever arm 130 includes three apertures, which are used to secure the cantilever arm to the target sight 100. In one embodiment, illustrated in FIG. 5, two indexing pins or dowels 151 are inserted, respectively, in the outside apertures, and a screw or other fastener 153 is inserted through the center aperture to compress and secure the fixed end 132 of the cantilever arm 130 to the target sight 100. A main portion of the cantilever arm 130 extends from the fixed end 132. With reference back to FIG. 3B, the cantilever arm 130 may be mounted within the target sight 100 such that its main body is offset from a vertical or horizontal plane of the main body of the target sight 100. In FIG. 3B, note how the apertures of the fixed end 132 are not aligned to either a vertical or horizontal plane of the sight 100. Note, too, that the main portion of the cantilever arm 130 extends at an angle perpendicular to the fixed end 132. Since the fixed end 132 is angled from the main body of the target sight, the main portion of the cantilever arm also extends from the fixed end in a direction that is offset from any vertical or horizontal plane of the main body of the target sight 100.

In embodiments, the cantilever arm 130 extends between 50% and 95% of the length of the main body of the target sight. In other embodiments, the cantilever arm 130 extends between 80% and 90% of the length of the main body of the target sight. Final dimensions of the cantilever arm may be implementation specific.

Figure 5:
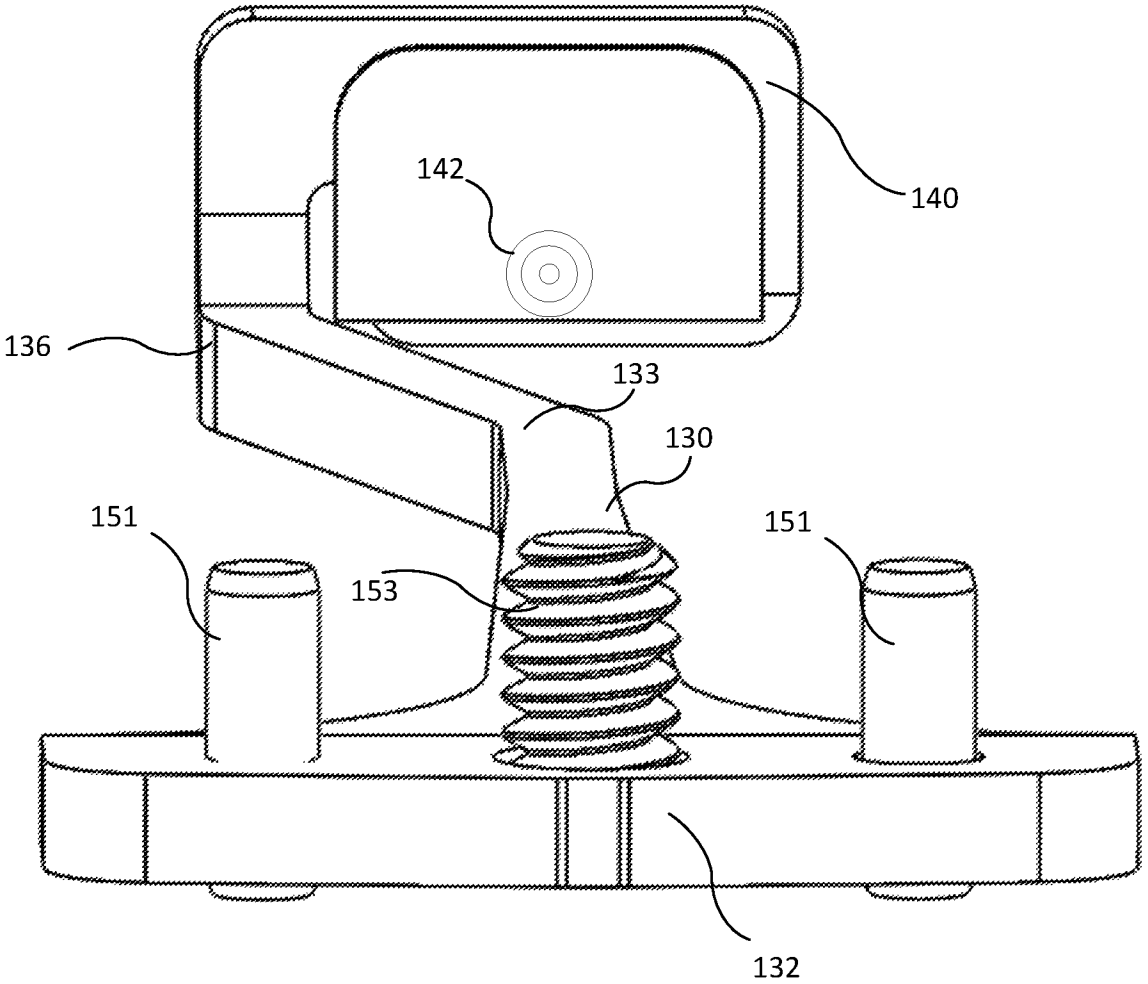
FIG. 5 is an end perspective view of the cantilever arm illustrated in FIG. 4, according to embodiments of the disclosure

Further illustrated in FIG. 5 is an emitter carrier 140, on which a target emitter 142 is mounted. The emitter carrier 140 may be integrally molded or formed as a part of the cantilever arm 130. In other embodiments the emitter carrier 140 is a separate element that is attached to the cantilever arm 130 at the termination 136. Electrical leads that couple to the target light emitter are also not illustrated in FIG. 5, for clarity. Such leads provide an electrical connection between the target light emitter 142 and an electrical circuit used to control the operation of the target light emitter. As described below, the electrical circuit that controls the electrical operation of the target sight 100 is typically powered by a battery.

Figure 6:
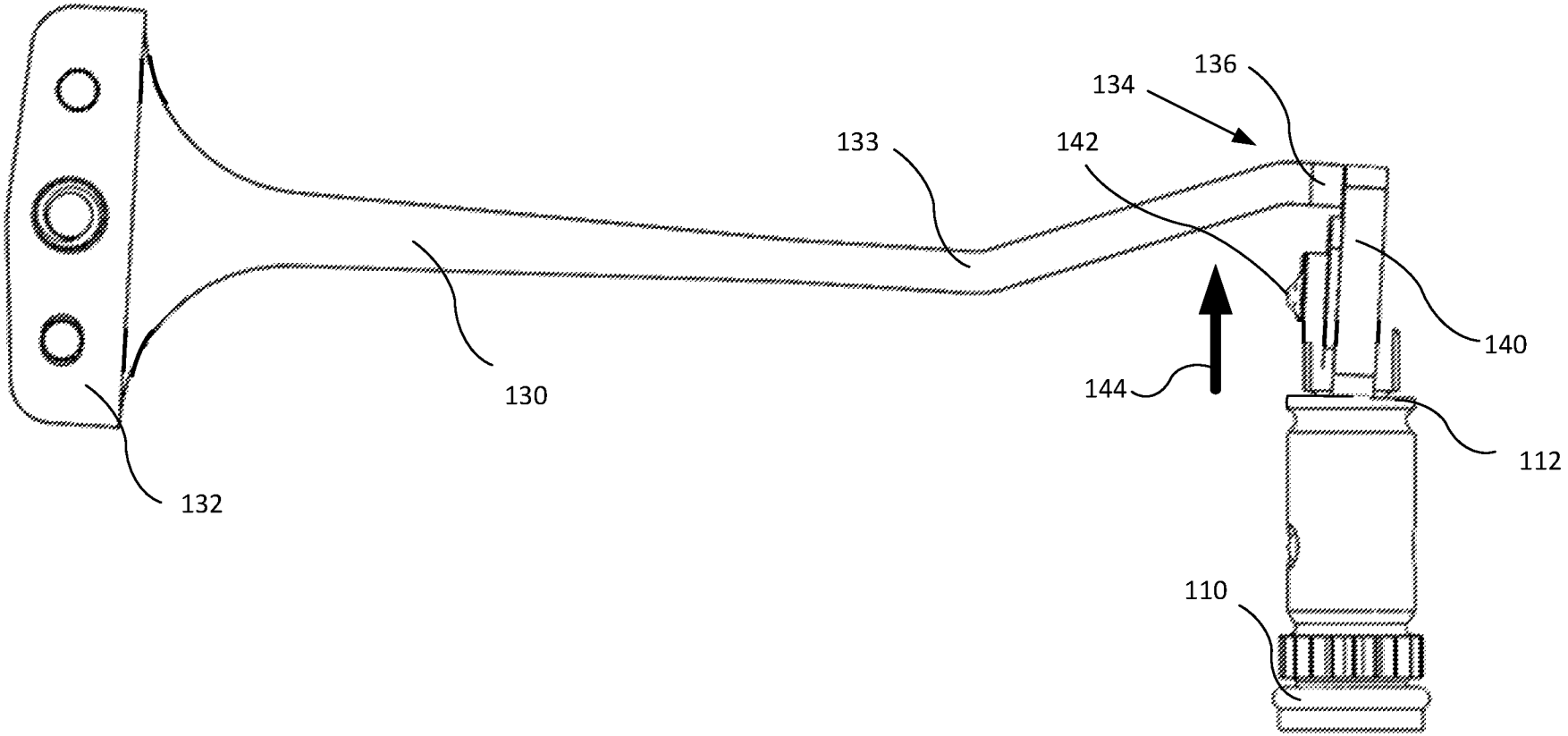
FIG. 6 is a bottom view of the cantilever arm illustrated in FIG. 4 and a windage adjustment according to embodiments of the disclosure.
Figure 7:
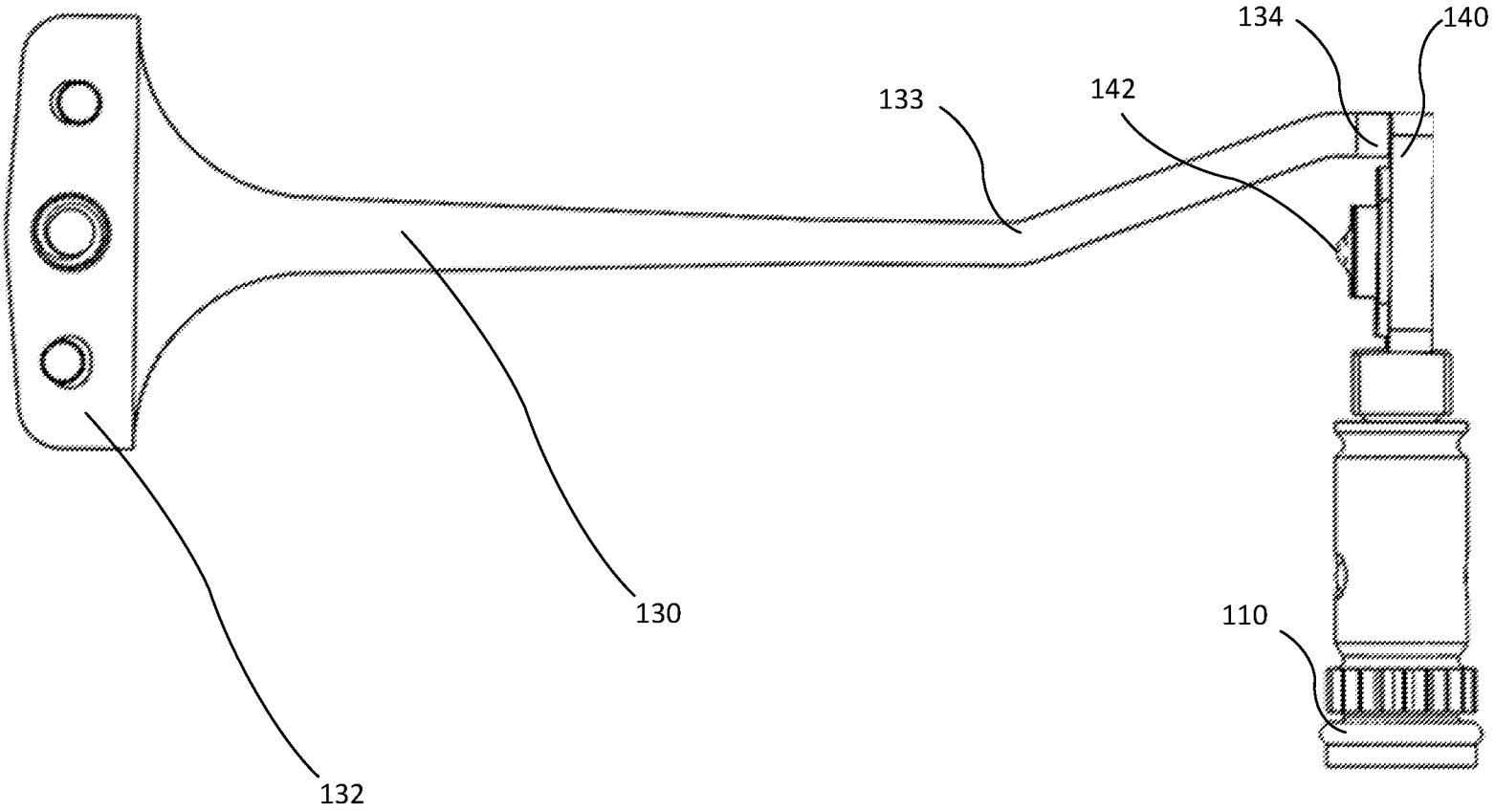
FIG. 7 is another bottom view of the cantilever arm and windage adjustment according to embodiments of the disclosure.

FIG. 6 illustrates a top view of the cantilever arm 130 and windage adjustment 110 components of the target sight 100, in isolation. The windage adjustment 110 may include an assembly of, for example, an adjustment screw, a bias spring, and a spring retainer. Other embodiments of the windage adjustment 110 are possible so long as they preserve the function of controlling the lateral position of the emitter carrier 140 and the target emitter 142. FIGS. 6 and 7 illustrate the results of the biased mounting position of the cantilever arm 130 to the long axis of the target sight 100 described above with reference to FIG. 3B. When the windage adjustment 110 is installed in the housing of the target sight 100, it creates an offset to the free state of the cantilever arm 130. The cantilever arm 130 is formed of plastic, nylon or other durable material that may bend, or flex, without permanent deformation. In some embodiments the cantilever arm 130 is formed of metal, such as spring steel, titanium, beryllium copper, or other spring metal having resilient properties. Additionally, the cantilever arm 130 may be formed to include a pre-bend 133 between its fixed end 132 and movable portion 134. FIG. 6 illustrates a bias force 144 created as a result of the mechanical interference between the windage adjustment 110 and the emitter carrier 140 based on the offset mounting position of the cantilever arm 130 relative to the target sight 100 housing, as described above. In other words, as the windage adjustment 110 is inserted into the housing of the target sight 100, a bias force represented as reference 144 is imparted to the emitter carrier 140 portion of the cantilever arm 130. The amount or degree of pre-bend 133 may also add to or reduce the bias force 144 depending on the amount of pre-bend 133 in the cantilever arm 130. In the biased position, the emitter carrier 140 is forced to the desired location by a portion 112 of the windage adjustment 110 that physically contacts the emitter carrier 140 as the windage adjustment is controlled by the user. In operation, adjusting the windage adjustment 110 allows the user to generate a controllable amount of lateral movement of the movable portion 134 of the cantilever arm 130, and, by extension to the emitter carrier 140. This lateral movement of the emitter carrier 140 generated by controlling the windage adjustment 110 causes the attached target light emitter 142 to move relative to the reflective glass 108 of the target sight 100 (FIG. 2B), thereby allowing the shooter to laterally adjust (left/right) the resulting target dot relative to the firearm barrel. Note that, when movements to the windage adjustment 110 are made, due to the flexible nature of the cantilever arm 130, only the moveable portion 134 of the cantilever arm moves, while the fixed end 132 of the cantilever arm remains fixed within the target sight 100.

Figure 8:
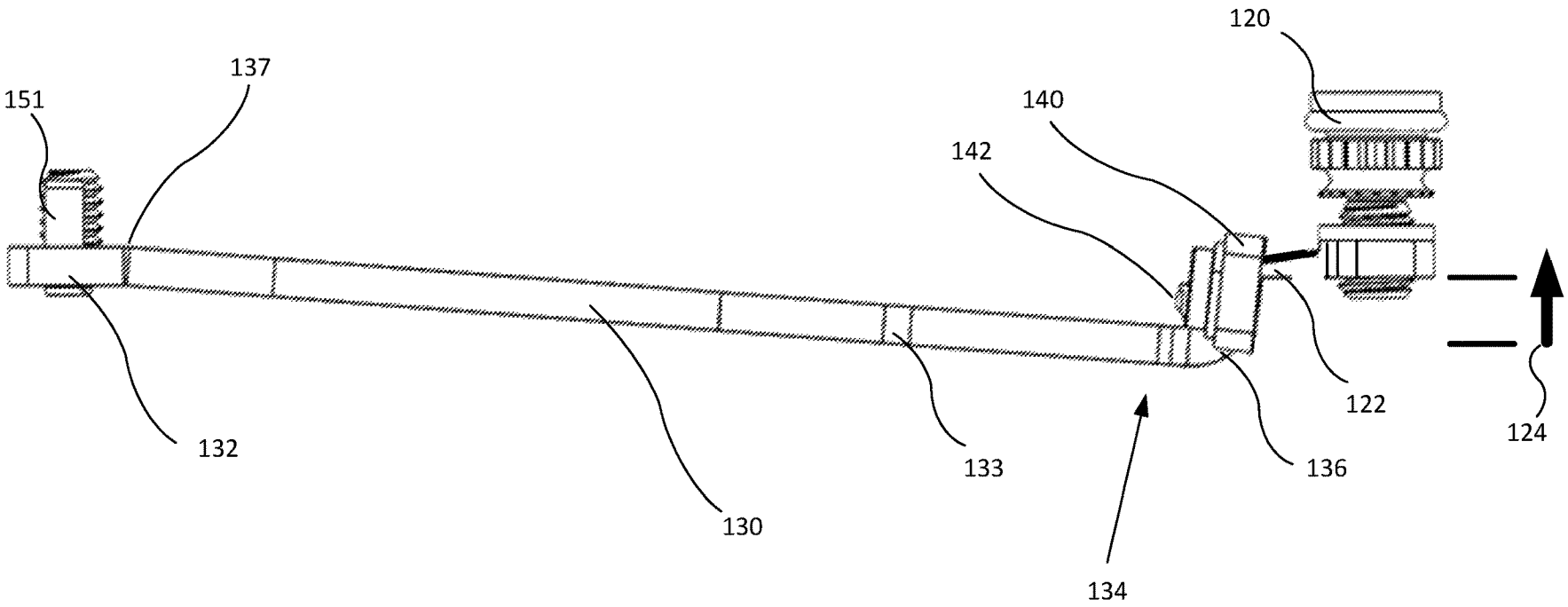
FIG. 8 is a side view of the cantilever arm illustrated in FIG. 4 and an elevation adjustment according to embodiments of the disclosure.
Figure 9:
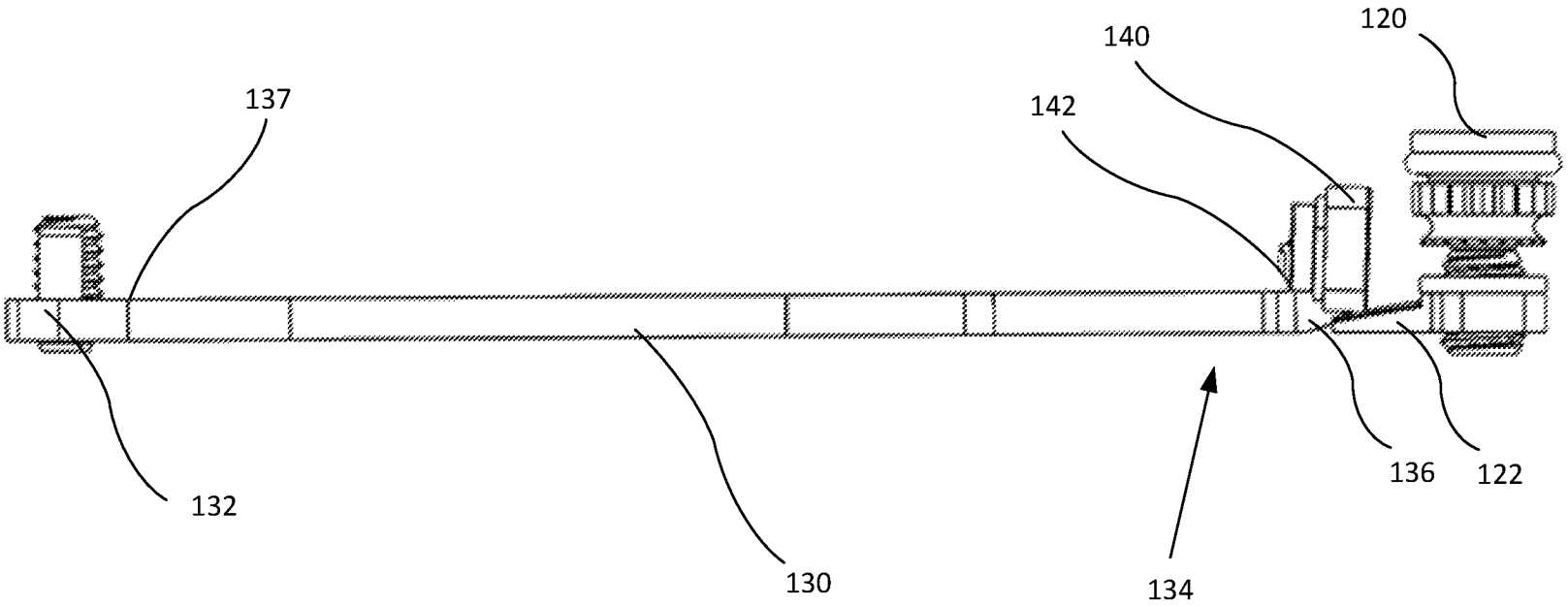
FIG. 9 is another side view of the cantilever arm and elevation adjustment according to embodiments of the disclosure.

Similarly to the lateral adjustment described above, the flexible nature, pre-bend characteristics, and mounting position of the cantilever arm 130 within the target sight 100 further allows an elevation (up/down) adjustment of the target light emitter 142 as well. This elevation adjustment allows the shooter to adjust the elevation of the target dot, which translates to distance between the firearm and the intended target. An elevation bias of the cantilever arm 130 is illustrated in FIGS. 8 and 9 by illustrating a decreasing amount of pre-bend in a pre-bend portion 137 of the cantilever arm between the locations of the cantilever arm 130 in FIGS. 8 and 9. In FIG. 8, the pre-bend portion 137 biases the movable portion 134 of the cantilever arm 130, and, by extension, the emitter carrier 140, in a downward direction. When the elevation adjustment 120 is installed in the housing of the target sight 100, it forces the emitter carrier 140 upwards, away from the barrel of the firearm. This results in a biasing force 124 into the elevation adjustment 120, as shown in FIG. 8. The elevation adjustment 120 may include a tab 122 that provides purchase into the emitter carrier 140. This purchase allows the elevation position of the emitter carrier 140 to be controlled by a user operating the elevation adjustment 120, such as by turning an adjustment screw. The elevation adjustment 120 may include an assembly of, for example, an adjustment screw, a bias spring, and a spring retainer. Other embodiments of the elevation adjustment 120 are possible so long as they preserve the function of controlling the elevation position of the emitter carrier 140. FIG. 9 illustrates the emitter carrier 140, held by the cantilever arm 130 in an elevated position relative to the position of the emitter carrier 140 in FIG. 8.

In operation, the windage adjustment 110 and elevation adjustment 120, individually and independently, may be adjusted from min to max ranges as the cantilever arm 130 flexes to move the emitter carrier 140 into its controlled position. Moving the emitter carrier 140 causes the flexible cantilever arm 130 to react the load into the fixed end 132. This action results in a reaction force from the emitter carrier 140 into the adjustments 110, 120. This force maintains the location of the emitter carrier 140, and, by extension, the target light emitter 142. Thus, this targeting system including the flexible cantilever arm 130 allows controlled adjustment of the target light emitter 142 in both lateral and elevation directions. The adjustments 110, 120 mechanically interfere with the emitter carrier 140 in such a way that the flexible cantilever arm 130 cannot be jolted nor stuck in a state other than resting where adjusted.

With reference back to FIGS. 1B, 2A, and 2B, embodiments according to the disclosure additionally include a battery retaining system that allows different thicknesses of a battery source for the target light emitter 142 to be used. As is well known, a thin-cell or button battery typically powers reflex sights.

As illustrated in the above figures, the battery for the target sight 100 is located to one side of the target sight. This placement allows for a lower deck height for the target sight 100 compared to other sights. This deck height directly affects the backup iron sight 106 that is integrated into the sight, as illustrated in FIG. 2A, allowing it to be lower to the barrel than conventional target sights, which increases accuracy. This design also allows for modularity with battery caps. The battery for the target sight sits in a battery cup having a threaded perimeter, the position of which is illustrated at location 210 of FIG. 1B. A battery cap 220 includes mating threads around its internal perimeter that engage the threads of the battery cup. Different battery caps 220 may be used to secure the battery to the target sight 100 to accommodate the different thicknesses of different batteries. For example, a user may select to power the target sight 100 by any one of batteries CR1616, CR1620, and CR1632. The lowest capacity battery, CR1616, is the thinnest, and therefore, when the cap 220 is threaded into place to secure the battery, the cap has a relatively low protrusion from the target sight 100. If the user selects a thicker battery, the cap 220, which may be a different cap than the once used for the thinner battery, may protrude further from the target sight. The battery cap 220 for the thickest battery, in the above example, CR1632, may protrude even further. The larger the battery capacity, the further its cap 220 protrudes out from the body of the target sight 100. The user can choose, battery life or slimness of the sight.

The previously described versions of the disclosed subject matter have many advantages that were either described or would be apparent to a person of ordinary skill. Even so, all of these advantages or features are not required in all versions of the disclosed apparatus, systems, or methods. All features disclosed in the specification, and all the steps in any method or process disclosed, may be combined in any combination, except combinations where at least some of such features and/or steps are mutually exclusive. Each feature disclosed can be replaced by alternative features serving the same, equivalent, or similar purpose, unless expressly stated otherwise.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," "left," "upward," and "downward" are used for convenience and in reference to the views provided in figures. But the target sight and components thereof may have a number of orientations in actual use. Thus, a feature that is vertical, horizontal, to the right, or to the left in the figures may not have that same orientation or direction in actual use.

We claim:

1. A reflex target sight for a firearm, comprising:
- a main body;
- an elongated, flexible emitter carrier having a first end fixed to the main body and having a movable portion at a second end opposite the first end, wherein the first and second ends of the flexible emitter carrier are coupled together by a flexible arm;
- a reflecting element; and
- a light emitter mounted to the movable portion of the flexible emitter carrier, the light emitter positioned to shine light toward the fixed first end of the flexible emitter carrier to strike the reflecting element and reflect at least a portion of the emitted light back to a user.

2. The reflex target sight of claim 1, in which the flexible arm is formed of plastic, nylon, or resilient metal.

3. The reflex target sight of claim 2, in which the flexible arm is formed of spring steel, titanium, or beryllium copper.

4. The reflex target sight of claim 1, in which the flexible arm includes one or more horizontal pre-bends.

5. The reflex target sight of claim 1, further comprising a user-controllable adjustment that allows a user to position the movable portion of the flexible emitter carrier relative to the main body of the target sight.

6. The reflex target sight of claim 5, in which, when the target sight is assembled, the movable portion of the flexible emitter carrier is biased against the user-controllable adjustment.

7. The reflex target of claim 5, in which the user-controllable adjustment comprises a first lateral adjustment and a second elevation adjustment.

8. A reflex target sight for a firearm, comprising:
- a main body;
- an elongated, flexible emitter carrier including:
  - a first end fixed to the main body,
  - a movable portion at a second end opposite the first end, and
  - a flexible arm coupled between the first end and the second end, the flexible arm including one or more permanent deformations in a first plane and one or more permanent deformations in a plane other than the vertical plane;
- a reflecting element; and
- a light emitter mounted to the movable portion of the flexible emitter carrier and structured to shine on the reflecting element, in which a portion of the light shone on the reflecting element is reflected back toward a user.

9. The reflex target sight according to claim 8, in which the light emitter is vertically offset from the first end of the flexible arm when the flexible arm is not biased by any outside force.

10. The reflex target sight of claim 8, further comprising a user-controllable adjustment that allows a user to position the movable portion of the flexible emitter carrier relative to the main body of the target sight.

11. The reflex target sight of claim 10, in which, when the target sight is assembled, the movable portion of the flexible emitter carrier is biased against the user-controllable adjustment.

12. The reflex target of claim 10, in which the user-controllable adjustment comprises a lateral adjustment and an elevation adjustment.

* * * * *